United States Patent [19]

Tvengsberg

[11] Patent Number: 4,642,822

[45] Date of Patent: Feb. 17, 1987

[54] RECREATIONAL POOL

[75] Inventor: Nils Tvengsberg, Oslo, Norway

[73] Assignee: Norca Industries Limited, Montreal, Canada

[21] Appl. No.: 654,947

[22] Filed: Sep. 27, 1984

[30] Foreign Application Priority Data

Oct. 4, 1983 [CA] Canada ..... 438339

[51] Int. Cl.[4] ..... E04H 3/18

[52] U.S. Cl. ..... 4/488; 4/492; 4/506; 4/513; D21/252; D25/2; 272/1 A

[58] Field of Search ..... 4/488, 506, 492, 496, 4/513; 272/1 A; D21/252, 244; D25/2

[56] References Cited

U.S. PATENT DOCUMENTS

| | | | |
|---|---|---|---|
| D. 198,092 | 4/1964 | Croushore | D21/252 |
| D. 203,753 | 2/1966 | Greenberg | D21/252 |
| D. 248,331 | 6/1978 | Ziegler et al. | D21/252 |
| D. 271,122 | 10/1983 | Mariol | D21/252 |
| 1,029,904 | 6/1912 | Allegretti | 272/1 B |
| 2,529,872 | 11/1950 | Hasselquist | 4/506 |
| 3,373,450 | 3/1968 | Brooks | 4/488 |
| 3,793,653 | 2/1974 | Brooks | D21/252 X |
| 3,908,205 | 9/1975 | Chase | D25/2 X |
| 4,045,019 | 8/1977 | Wade | 272/1 A |
| 4,510,632 | 4/1985 | Elsis | 4/488 |

*Primary Examiner*—Henry K. Artis

*Attorney, Agent, or Firm*—Russell, Georges, Breneman, Hellwege & Yee

[57] ABSTRACT

The specification describes the combination of a unitary water container or pool and a pair of play balls, the pool having a generally planar bottom wall and a peripheral rim surrounding the bottom wall and extending upwardly therefrom, the peripheral rim being formed in the shape of an animal and including recesses defining eye sockets, the play balls being shaped and dimensioned to be removably received in the recesses and arranged to have iris and pupil defining markings thereon.

5 Claims, 5 Drawing Figures

RECREATIONAL POOL

This invention relates to a recreational device for children and, particularly, to a combination toy and pool.

The present invention seeks to provide a children's recreational pool which is safe, sturdy and stable and yet which is amusing and entertaining for children.

Generally, the present invention provides the combination of a unitary water container or pool, having a generally planar bottom wall and a peripheral rim surrounding the bottom wall and extending upwardly therefrom, and a pair of play balls. A portion of the peripheral rim is formed in the shape of an animal and includes recesses which define eye sockets. The play balls are shaped and dimensioned to be removably received in the recesses and arranged to have the iris and pupil of an eyeball on their exterior surfaces.

These and other features of the invention will become more apparent from the following description in which reference is made to the appended drawings, wherein.

Figure 1:
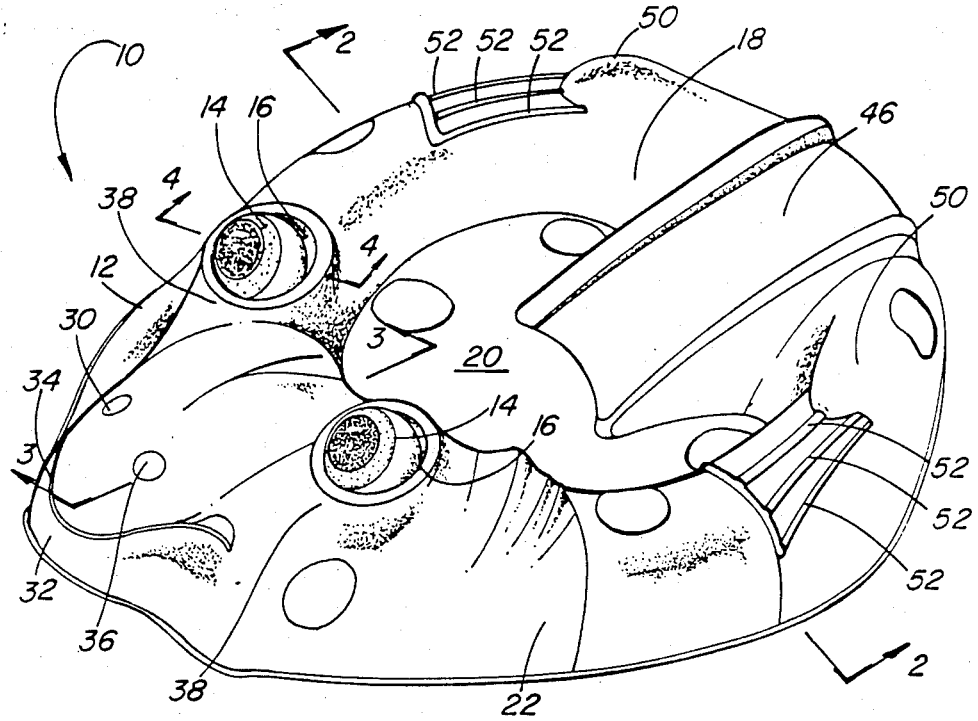
FIG. 1 is a perspective view of the recreational device of the present invention.

The recreational device 10 of the present invention is comprised of the combination of a body 12 and a pair of playballs 14,14 removably receivable in a pair of recesses or sockets 16,16 formed in body 12. As explained more fully below, body 12 is a water retaining container or pool 18 defined by a planar bottom wall 20 surrounded by an integral peripheral wall or rim 22. The rim is shaped to assume certain characteristics of an animal, such as the illustrated frog. The recesses define eye sockets and the balls define eyeballs.

Figure 2:
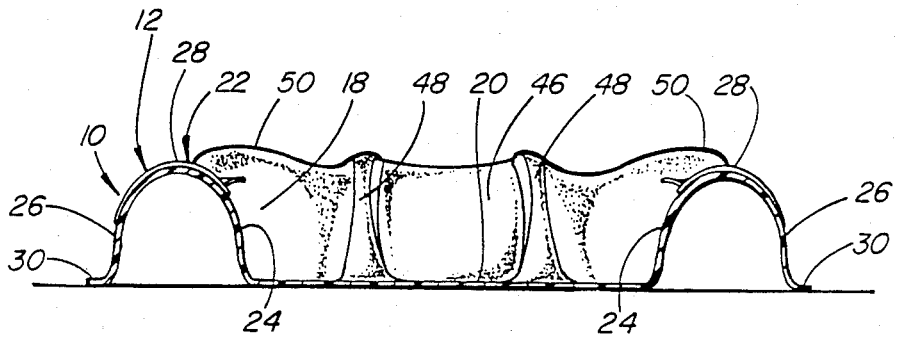
FIG. 2 is a transverse cross-sectional view taken along line 2—2 of FIG. 1.

Body 12 is a unitary structure constructed of synthetic plastic material in accordance with conventional practice. As best shown in FIG. 2, rim 22 is generally semi-torroidal in shape and has an inner wall portion 24, an outer wall portion 26 and a top wall portion 28. Inner wall portion 24 smoothly merges into bottom wall 20 and defines therewith a water retaining container or pool. Outer wall portion 26 terminates in an outwardly flared flange 30. It will be seen that this general configuration provides a sturdy, stable and safe swimming pool for children in that it is less susceptible to wind blowing when empty, presents no sharp edges, and weight placed on top wall portion 28 is transferred to the ground via inner and outer wall portions 24 and 26, respectively. Thus, there is less likelihood of stress cracks developing in the rim as tends to be the case in some conventional children's swimming pools. This configuration also allows moulding of the rim into shapes which are amusing and entertaining to children.

At front end 32 of body 12, rim 22 is moulded in the shape of the head of a frog including a mouth 34 and nostrils 36,36, for example, and, as already mentioned, recesses 16,16 which define eye sockets. The sockets are formed by upwardly directed projections 38 in top wall 28. Each projection terminates in a planar, annular upper surface 40 and a concentric, semi-spherical depression 42.

The other end 44 of body 12 is formed with a slide 46 which slopes downwardly and inwardly from top wall portion 28 to a bottom wall 20. Slide 46 includes a pair of parallel, longitudinally extending ridges 48 which serve as hand grips and guides. Protrusions 50, representing the legs of a frog, are moulded into rim 22 on each side of slide 46 while longitudinal ribs 52, representing the feet or flippers of a frog, are moulded in rim 22 forwardly of protrusions 50.

Figure 3:
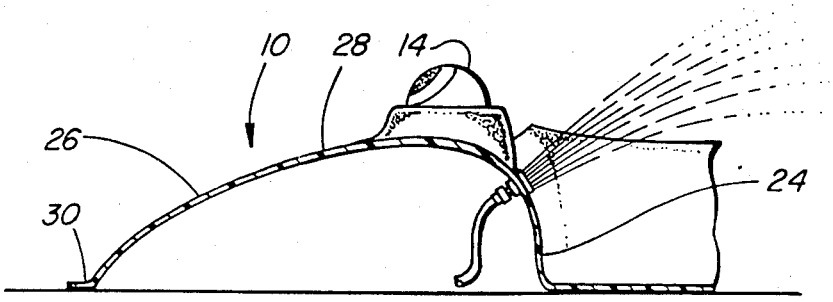
FIG. 3 is a partial longitudinal view taken along line 3—3 of FIG. 1.
Figure 4:
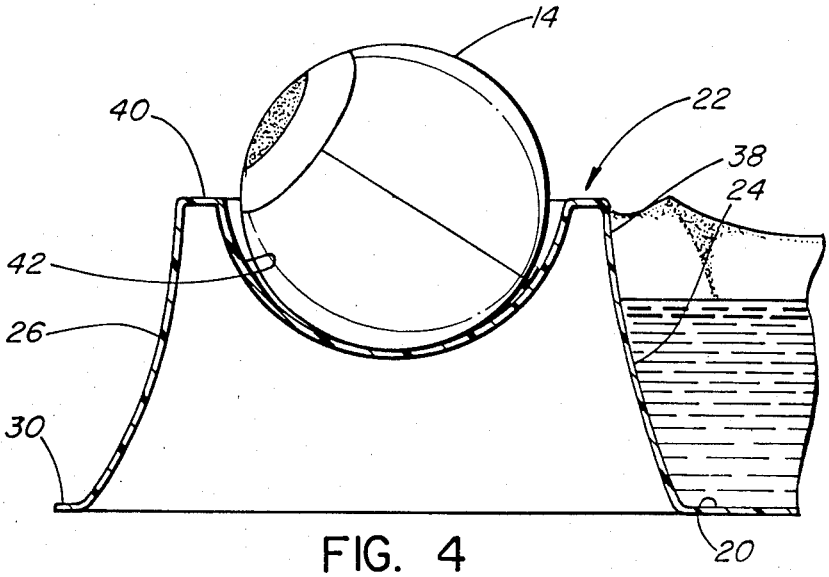
FIG. 4 is a cross-sectional view taken along line 4—4 of FIG. 1.

As shown in FIG. 3, a water spray nozzle 56 is secured to inner wall portion 24 between projections 38 and arranged so as to direct a spray of water inwardly and upwardly of body 12 at an angle of about 45°. The nozzle is adapted to be detachably connected to a conventional domestic water hose.

Balls 14,14 are generally spherical and include on their exterior surface markings representing the iris and pupil of an eye. The balls are eccentrically weighted so as to assume a normal, upright position under the influence of gravity, with the eccentric weight positioned so that the pupil is directed upwardly at an angle of about 45° in the normal position.

Figure 5:
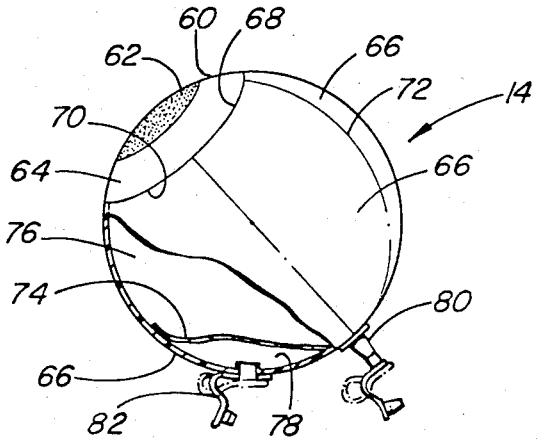
FIG. 5 is a side elevational view, partially in section, of a ball.

Preferably the balls are small inflatable beach balls as shown in FIG. 5. The balls are constructed of a plastic material conventionally used in the manufacture of beach balls and include a circular panel 60, on which the pupil 62 and iris 64 are painted or otherwise marked, and a plurality of spherical triangular panels 66. The base 68 of panels 66 are heat sealed or otherwise sealingly secured to the circumferential edge 70 of panel 60 while the circumferential edges 72 of panels 66 are sealed together. An interior spherical triangular panel 74 is sealed to one of panels 66 so as to define an interior air chamber 76 and interior water chamber 78. When filled with water, chamber 78 serves as the eccentric weight. A conventional valve and closure assembly 80 is provided for inflating chamber 76 while a liquid inlet and closure assembly 82 is secured to panel 66 for admitting water into chamber 78 and sealing same.

We claim:

1. A recreational device, comprising:

a unitary body constructed of synthetic plastic material, said body having a substantially planar bottom wall and an endless peripheral wall surrounding and extending upwardly from said bottom wall, said peripheral wall being generally U-shaped in cross section and including an inner side wall smoothly merging with said bottom wall and extending upwardly therefrom and defining with said bottom wall a water retaining container, a generally convexly curved top wall generally paralleling said bottom wall and merging smoothly from said inner side wall and an outer side wall merging smoothly from said top wall and extending downwardly toward and terminating at the plane containing said bottom wall, said peripheral wall having a portion at one end of said body formed in the shape of the head of a frog, said head portion having a pair of recesses representing eye sockets, a slide extending from said top wall at the end of said body remote from said one end toward said bottom wall and at an angle thereto; and a pair of inflatable balls, each said ball being generally spherical and being dimensioned to be removably received in one of said recesses, each said ball having an air receiving chamber and an eccentrically disposed liquid receiving chamber, each said chamber having passage means for admitting fluid therein and a closure means for closing said passage means, and means defining the iris and pupil of an eye on said ball.

2. A recreational device comprising: a unitary body constructed of synthetic plastic material and having a substantially planar bottom wall and an endless peripheral wall surrounding said bottom wall and extending generally upwardly therefrom so as to define therewith a water retaining container, said peripheral wall having a portion thereof formed at one end of said body in the shape of the head of an animal, said head portion having a pair of recesses defining eye sockets; and a pair of balls, each said ball being shaped and dimensioned to be removably received in one of said recesses, each said ball being spherical and having an air receiving chamber and an eccentrically disposed liquid receiving chamber, each said chamber having passage means for admitting fluid thereinto and closure means for closing said passage means.

3. A recreational device as defined in claim 2, said peripheral wall being generally U-shaped in cross section and including an inner side wall portion which integrally merges into and extends upwardly from said bottom wall, a generally convexly curved top wall portion generally paralleling said bottom wall and merging smoothly and integrally from said inner side wall and an outer side wall portion merging smoothly and integrally from said top wall portion and extending downwardly therefrom toward and terminating at the plane containing said bottom wall.

4. A recreational device as defined in claim 2, said body further including a slide portion extending upwardly from and at an angle to said bottom wall to said peripheral wall remote from said head portion of said peripheral wall.

5. A recreational device as defined in claim 2, said body portion further including a water spray nozzle secured to said peripheral wall between said recesses, said nozzle being adapted to be connected to a hose and being disposed in said peripheral wall so as to direct a spray of water inwardly of said body when subjected to water under pressure.

* * * * *